US006116983A

United States Patent [19]

Long et al.

[11] Patent Number: 6,116,983

[45] **Date of Patent: *Sep. 12, 2000**

[54] REMOTELY CONTROLLED CRIB TOY

[75] Inventors: Jennifer Long, Providence, R.I.; Christopher Cimerman, Depew, N.Y.; James P. Meade, Hamburg, N.Y.; Charles D. Smith, Lockport, N.Y.; James A. Bishop, Jr., North Tonawanda, N.Y.; Elisabeth Krisel, Great Neck, N.Y.; William R. Hewitt, West Falls, N.Y.

[73] Assignee: Mattel, Inc., El Segundo, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/912,164

[22] Filed: Aug. 15, 1997

[51] Int. Cl.[7] ..... A63H 33/30

[52] U.S. Cl. ..... 446/227; 446/397; 446/408; 446/485

[58] Field of Search ..... 446/175, 227, 446/408, 485, 397; 434/307 R, 308; 365/45; 369/31; 340/692, 825.69, 825.72

[56] References Cited

U.S. PATENT DOCUMENTS

| | | | |
|---|---|---|---|
| 4,640,034 | 2/1987 | Zisholtz | 40/455 |
| 4,777,938 | 10/1988 | Sirota . | |
| 4,815,683 | 3/1989 | Ferrante | 248/205.2 |
| 4,973,286 | 11/1990 | Davison | 446/175 |
| 4,984,380 | 1/1991 | Anderson | 40/455 |
| 5,032,099 | 7/1991 | Chan | 446/408 |
| 5,057,051 | 10/1991 | Babicz | 446/408 |
| 5,073,825 | 12/1991 | Holdredge et al. | 434/307 R |
| 5,255,038 | 10/1993 | Suzuka | 354/266 |
| 5,310,377 | 5/1994 | Joja | 446/219 |
| 5,385,344 | 1/1995 | Miller et al. | 273/460 |
| 5,387,146 | 2/1995 | Smith et al. | 446/485 |
| 5,446,934 | 9/1995 | Frazier | 5/655 |
| 5,450,841 | 9/1995 | Whitaker et al. . | |
| 5,476,407 | 12/1995 | Hall, Jr. | 446/397 |
| 5,478,268 | 12/1995 | Au | 446/227 |
| 5,480,340 | 1/1996 | Bogar | 446/227 |
| 5,501,627 | 3/1996 | Ekstein | 446/175 |
| 5,555,664 | 9/1996 | Shockley | 43/1 |
| 5,625,608 | 4/1997 | Grewe et al. . | |
| 5,635,898 | 6/1997 | Walters et al. . | |
| 5,657,380 | 8/1997 | Mozer . | |
| 5,741,185 | 4/1998 | Kwan et al. | 446/175 |

FOREIGN PATENT DOCUMENTS 2725116 4/1996 France .

OTHER PUBLICATIONS

Toshiba TV Owners Manual (Model CF2051A) for TV purchased Jul. 8, 1991, Jul. 1981.

*Primary Examiner*—Robert A. Hafer
*Assistant Examiner*—Jeffrey D. Carlson
*Attorney, Agent, or Firm*—Morgan, Lewis & Bockius LLP

[57] ABSTRACT

A remotely-controlled crib toy generates audio and/or video sensible output in response to user commands received by a remote control system. The nature and duration of the sensible output can be selected by the user. The sensible output is selected to be soothing to an infant.

20 Claims, 16 Drawing Sheets

REMOTELY CONTROLLED CRIB TOY

BACKGROUND OF THE INVENTION

The invention relates to crib toys, and more specifically to a crib toy that produces sensible output by remote control.

There are a variety of known crib toys that can be mounted to a crib to provide visual or audible stimulus for an infant occupying the crib. The toys can take the form of mobiles, such as is disclosed in U.S. Pat. No. 4,984,380 to Anderson. The crib toy of Anderson is activated by a passive infrared sensor that detects motion of the infant, similar to the sensors used in security systems. The toy uses a wall-mounted tape player that can be activated by a conventional infrared remote control that is mounted on the mobile and is in turn automatically activated by the mobile's passive infrared sensor.

Another example of a crib toy is disclosed in U.S. Pat. No. 4,973,286 to Davison. This toy has a housing mountable to a crib rail and moveable miniature cartoon figures. The figures are moved, and music is generated, when the toy is activated, in response to detection of sound generated by, for example, the infant or by toys on the housing manipulated by the infant.

Parents frequently wish to sooth a restless infant and/or to promote the infant's sleep by providing soothing sounds to the infant. Known crib toys require activation by the infant or by the parent through direct physical interaction with the toy. However, the parent often does not wish for the infant to be aware of the parent's presence, as the infant will then be less likely to commence or resume sleep. It would therefore be desirable for a parent to operate the crib toy remotely, from a position not visible to the infant. Known sound activated systems such as disclosed in Anderson are not suitable because the infant would be disturbed by the parent generating sufficient loud noises to activate the device. There is therefore a need for a crib toy that can be actuated remotely without disturbing the infant.

SUMMARY OF THE INVENTION

The shortcomings of the prior art are overcome by the disclosed crib toy. The crib toy has a main unit that can be mounted to a crib rail or otherwise placed in operative range of the infant, and a remote unit. The main unit houses sensible output generators to produce video and/or audio output. The parent or other user can initiate operation of the output generators from the remote unit. The remote unit communicates command signals to the main unit via an infrared ("IR") transmissions.

DETAILED DESCRIPTION

A presently preferred embodiment of a crib toy incorporating the principles of the invention is shown in FIGS. 1–5. A functional description of the crib toy is presented first, followed by a description of a presently preferred physical implementation.

Figure 1A:
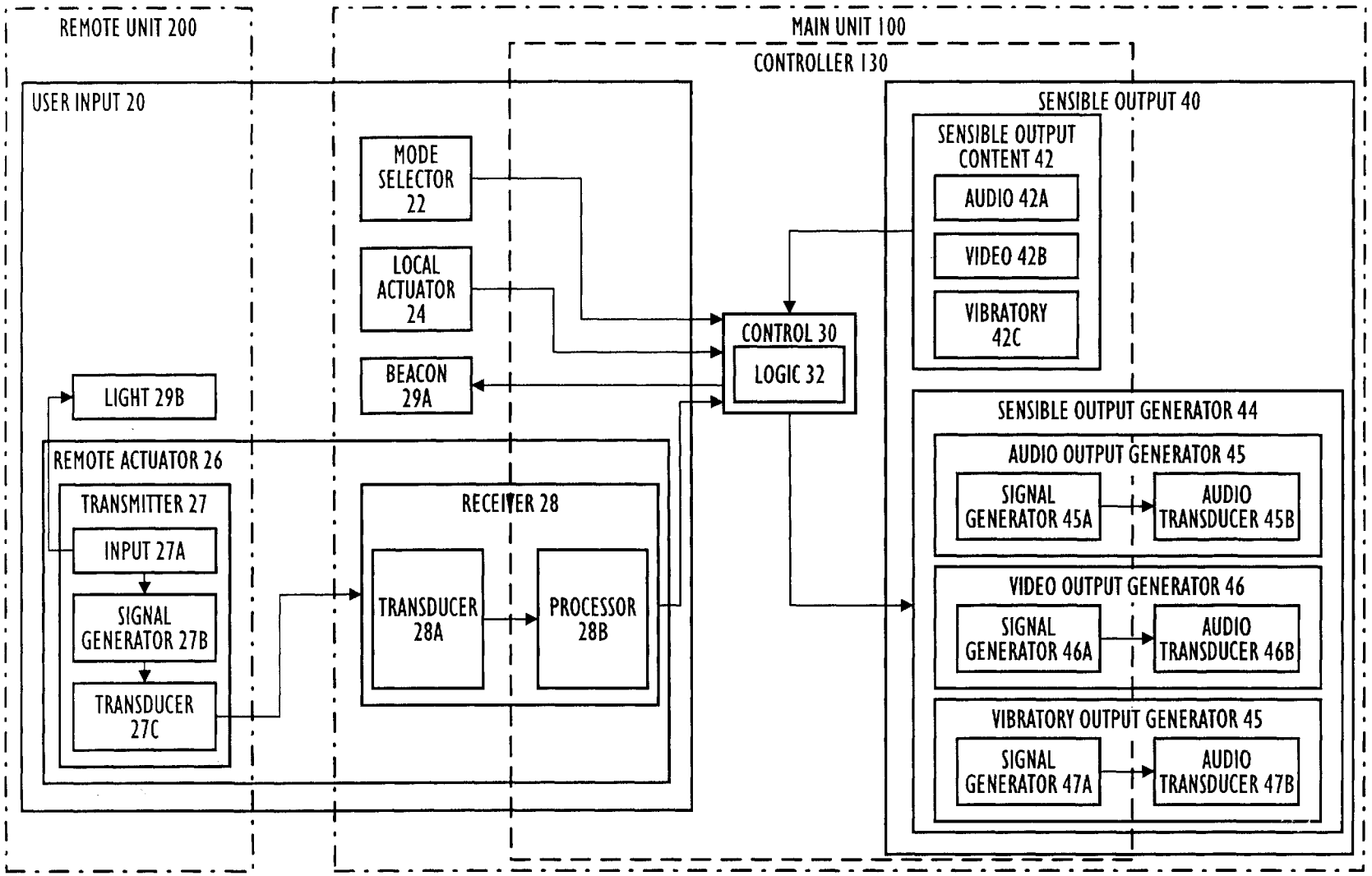
FIG. 1A is a functional block diagram of a remotely controlled crib toy embodying the principles of the invention.
Figure 1B:
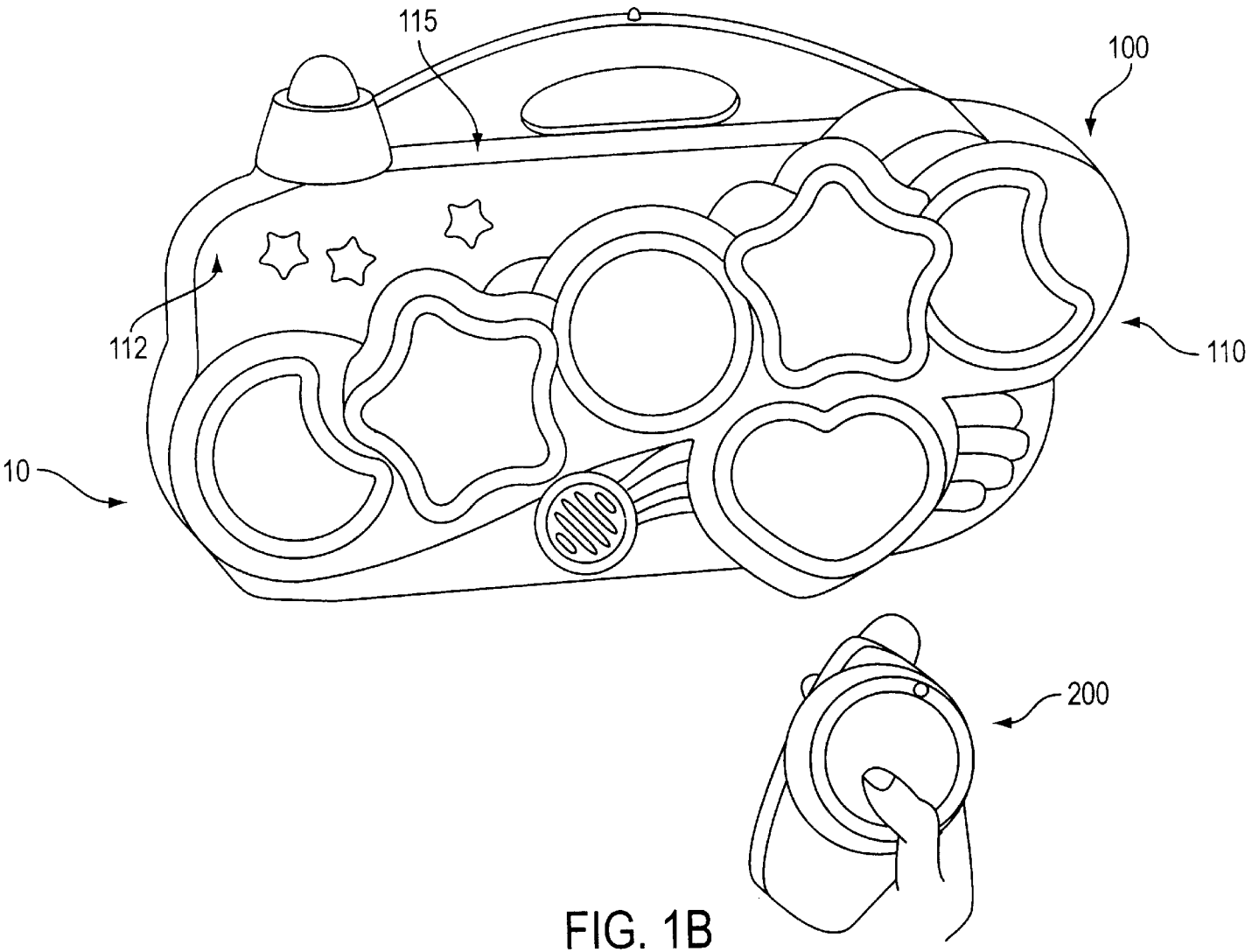
FIG. 1B illustrates a physical embodiment of the remotely controlled crib toy of FIG. 1A.

As shown in the functional block diagram of FIG. 1A, remotely controlled crib toy 10 includes a user input block 20, a control block 30, and a sensible output block 40. In response to user input via the input block 20, the control block controls the output of selected sensible output, such as mechanical vibration, musical notes, sound effects, light patterns or combinations of musical notes and light patterns, from the output block 40.

Output block 40 includes sensible output content 42, which includes audio content 42A, video content 42B, and vibratory content 42C. Audio content 42A can include, for example, in either digital or analog form, musical tones (which can be combined to form musical compositions), speech (recorded or synthesized), or sounds (including recorded natural sounds, or electronically synthesized sounds). Video content can include, for example, in analog or digital form, still or video images, or simply control signals for activation of lamps or other light-emitting devices. Vibratory content can include, for example, control signals for activation of devices that produce mechanical vibrations that can be communicated to a surface in contact with an infant so that the infant can feel the vibration.

The output content can be sensibly communicated to an infant for hearing, feeling, or viewing by sensible output generator 44, which can include an audio output generator 45, a video output generator 46, and a vibratory output generator 47. Audio output generator 45 can include an audio signal generator 45A, which converts audio output content 42A into signals suitable for driving an audio transducer 45B, such as a speaker, for converting the signals into audible sound waves. Video output generator an include a video signal generator 46A, which converts video output content 42B into signals suitable for driving a video transducer 46B, such as a display screen or lights, for converting the signals into visible light waves. Video output generator can also include moving physical objects, such as miniature figures, to produce visual stimulus to the infant. Vibratory output generator 47 can include a vibration signal generator 47A, which converts vibratory output content 42C into signals suitable for driving vibratory transducers 47B, such as an electric motor driving an eccentrically-mounted weight, for converting the signals into mechanical vibrations. The selection of the output content, and the performance attributes of the output generators, should be informed by the goal of generating sensible output that is appealing or soothing to an infant. Audio pressure levels should be selected to calm, rather than startle, the infant. Audio content should be pleasing, comforting, and/or rhythmic or melodic. Video output intensities should be high enough that the video output is visible to a user in a darkened room, but low enough not to keep a baby awake. Video output should be pleasing or familiar static patterns, or animated or rhythmically repeated abstract patterns. Vibration levels should be selected to detectible by, and soothing to, but not overly stimulating of, the infant. Vibratory content should be pleasing, comforting, and/or rhythmic.

Control block 30 controls sensible output block 40, selecting the output content to be output and activating the output generator 44 to operate on the selected output content. The operation of control block 30 can be governed by control logic 32, which can be, for example, computer software code. Control logic 32 can select content to be output repetitively or non-repetitively, randomly or in fixed sequences, and/or for short or long durations. The video, vibratory, and audio output can be coordinated to enhance the pleasing effect.

User input block 20 includes a mode selector 22, a local actuator 24, and a remote actuator 26, by which the user can provide input to control block 30 to influence the selection of output content and to initiate its output. Mode select 22 allows the user to select from among output modes. Illustrative output modes include long and short versions of combined video and audio output and a short version of an audio-only output. For example, the audio content 42A can include a set of musical tones and a set of sound effect segments, and the video content can include a selected sequence of illumination instructions for lamps. Control logic 32 includes sets of sequences in which the musical tones can be output to produce recognizable tunes. A "long" program can include a predetermined sequential output of the sets of tone sequences, producing a sequence of musical tunes. Lamps can be illuminated in response to a set of illumination instructions correlated with the playing of the tunes. A"short" program can include output of a single one of the sets of tone sequences, producing one musical tune, also with coordinated lights. A"sound effects" program can include output of a single one of the sound effect segments.

The local and remote actuators 24 and 26 allow the user to input simple commands such as"start," "stop," or"repeat" via simple mechanisms such as mechanical contact switches. Local actuator is physically proximate to the output block 40. In contrast, remote actuator 26 includes a transmitter portion 27 that can be operated from a position physically remote from the output block 40, and a receiver portion 28 physically proximate to the output block 40. A command signal can be communicated between the transmitter portion and the receiver portion without a physical link, such as in electromagnetic signal (including infrared and radio frequency) or an acoustical (including ultrasonic), or with a physical link, such as an electrical signal carried by a conductor coupling the transmitter portion and the receiver portion.

In the illustrated embodiment, a wireless short-wave infrared system is used for communication of command signals. The transmitter 26 therefore includes an input button 27A (which the user can press to initiate a command signal), a command signal generator 27B activated by the button 27A, and an infrared emitting transducer (an LED) 27C. Receiver 28 includes an infrared receiving transducer (a photosensor) 28A and a processor 28B to interpret signals received by transducer 28A.

User input block 20 further includes two feedback mechanisms for the user. The first is a beacon light 29A associated with, and physically proximate to, receiving transducer 28A. Beacon light 29A is illuminated (for example, in a flashing or intermittent fashion) when the system is active and ready to receive command signals from the remote actuator 26. This gives the user a visual cue to the system's active state, and further helps the user to locate the system in a darkened room. The second feedback mechanism is a remote signal light 29B associated with, and physically proximate to, transmitting transducer 27C. Signal light 29B is illuminated when the command signal generator 27B is generating command signals, to provide visual confirmation to the user that actuation of the input button 27A has resulted in the production of a command signal.

To use the crib toy, a user places the sensible output generator and the infant to be soothed within an operative range of the output generator. The user selects an output mode with mode select 22, and issues a"start" command via local actuator 24 or remote actuator 26. The control 30 receives the mode selection and the start command, selects the corresponding output content, and activates the output generator 44 to generate the selected output content. Use of the remote actuator to issue commands allows the user to be positioned remote from the infant, so that the soothing output can be generated while minimizing the risk that the user will disturb, or attract the attention of, the infant.

A physical implementation of this embodiment is now described with reference to FIGS. 1B to 5. Crib toy 10 includes a main unit 100 and a remote unit 200. The correspondence between the functional elements and the main and remote units is illustrated in FIG. 1A by phantom-lined boxes, identified as main unit 100 and remote unit 200, drawn around the functional elements. Electrical schematic illustrations of the main unit 100 and remote unit 200 are shown in FIGS. 2H and 3G, respectively.

As shown in FIGS. 1A and 2A–2F, the elements of main unit 100 are contained and supported in main unit housing 110. Main unit housing 110 is composed of front and rear housing halves 112, 114. Main unit housing 110 has a top portion 115, with a centrally-disposed and integrally-formed handle 116 and a remote receiver mount 120. Main unit housing 110 also includes mounting 140, by which the housing can be mounted to a supporting structure, such as an infant crib, in operative proximity to the infant. Main unit housing 100 further includes a remote receptacle 150, in which remote unit 200 can be stored.

Mounting 140 is disposed on the main housing rear 114 and includes identical left and right straps 141 and 142 for mounting the main unit 100 on a fixed support, such as an upper rail R of an infant's crib. As shown in FIG. 2C, main unit 100 can be mounted to rail R with the main housing rear 114 abutting the rail and with the strap 141 wrapped around the rail. The strap free end 141A (opposite from the strap's fixed end 141 C) is fixed to a post 143 by fitting the post through one of several holes 141 C located near the strap's free end 141 A. The post 143 includes a retaining boss 143A to prevent the strap from releasing when the main unit is held on support 140. Although the straps are particularly suited for supporting main unit 100 on a crib railing, they can also be used to suspend the main unit from other suitable supports positioned in operative range of the infant to be soothed. Alternative mounting mechanisms will be apparent to the artisan. The main unit can also simply be placed on a horizontal support surface.

In the illustrated embodiment, the video output generator 46 includes a light array 180, which is disposed on the front face 111 of main unit housing 110, and includes five light assemblies 181. As best seen in FIG. 2D, each light assembly 181 includes a light 182 mounted in a mount 184, which is disposed at the apex of a conical light support 185. A translucent graphic screen 183 is disposed at the base of the conical light support 185. Each screen 183 consists of a single, die-cut transparency of an image pleasing to an infant. In the illustrated embodiment, the images are cartoon renderings of juvenile animals (rabbit, lamp, kitten, puppy, and mouse). Lights 182 are 4.5 volt, 100 mA "grain of wheat" bulbs, selected to produce an appropriate level of light output.

Audio output generator 44 includes a speaker 195, mounted in main unit housing 110 behind a perforated speaker grill 196. The speaker is a 1" (2.5 cm) diameter driver, and is preferably driven to a sound pressure level of less than approximately 70 dB at 9.8" (24.5 cm) from the axial front of the speaker source.

The audio signal generator 46*a*, video signal generator 45A, sensible output content 42, and control block 30 are all implemented in the illustrated embodiment on controller 130, which is a model EM2270G two-tone and sound effects generating IC available from Elan Micro-Electronics Corporation of Taiwan. The audio content 42A is stored in digital form in a memory portion of controller 130. Audio content 42A includes sets of tone identifiers arranged in sequences corresponding to musical tunes. Ten such sets of tone identifiers are stored, allowing generation of ten musical tunes, such as Brahm's Lullaby, Edelweiss, and Twinkle Twinkle Little Star. Audio content 42A further includes three sound effect segments, which are digitized recordings of sounds such as singing birds, chirping crickets, and rushing water. Controller 130 has the built-in capability to produce tones identified by the tone identifiers, and to drive speaker 195 to the desired sound pressure level with transistor amplifier 194.

The physical implementation of user input block 20 will now be described. Local actuator 24 is implemented as main unit input switch 160, which is a momentary contact switch with a large, heart-shaped button 161 mounted to the front face 111 of main unit housing 110 (see FIG. 2A), where it is readily accessible to, and easily activated by, either the adult user or the infant.

Mode selector 22 is implemented as mode select switch 170, which is a single pole, four position slider switch, with a slider button 171 positioned on the rear side of the housing upper portion 115 (see FIGS. 2E, 2F), where it is readily accessible to the adult user but not to the infant. The four output lines from mode select switch 170 are coupled to controller 130 to provide signals to select the modes of operation for the crib toy. As described in more detail below, there are four modes of operation, three producing different sensible outputs and a fourth corresponding to an "off" position for the crib toy 10.

Remote actuator 26 is implemented as an short-wave infrared remote control system with components in the main unit 100 and in the remote unit 200. The receiver 28 is implemented as remote receiver 320, with a photo sensor 322 (corresponding to receiving transducer 28A), which in the illustrated embodiment is a model PIC-12043SM, available from Kodenshi, of China, which converts incident light in the short-wave infrared spectrum into electrical signals supplied to controller 130, which includes the function of command signal processor 28B to process the electrical signals received from photosensor 322 and determine whether the received IR signal is a command signal from remote transmitter 27.

Figure 2A:
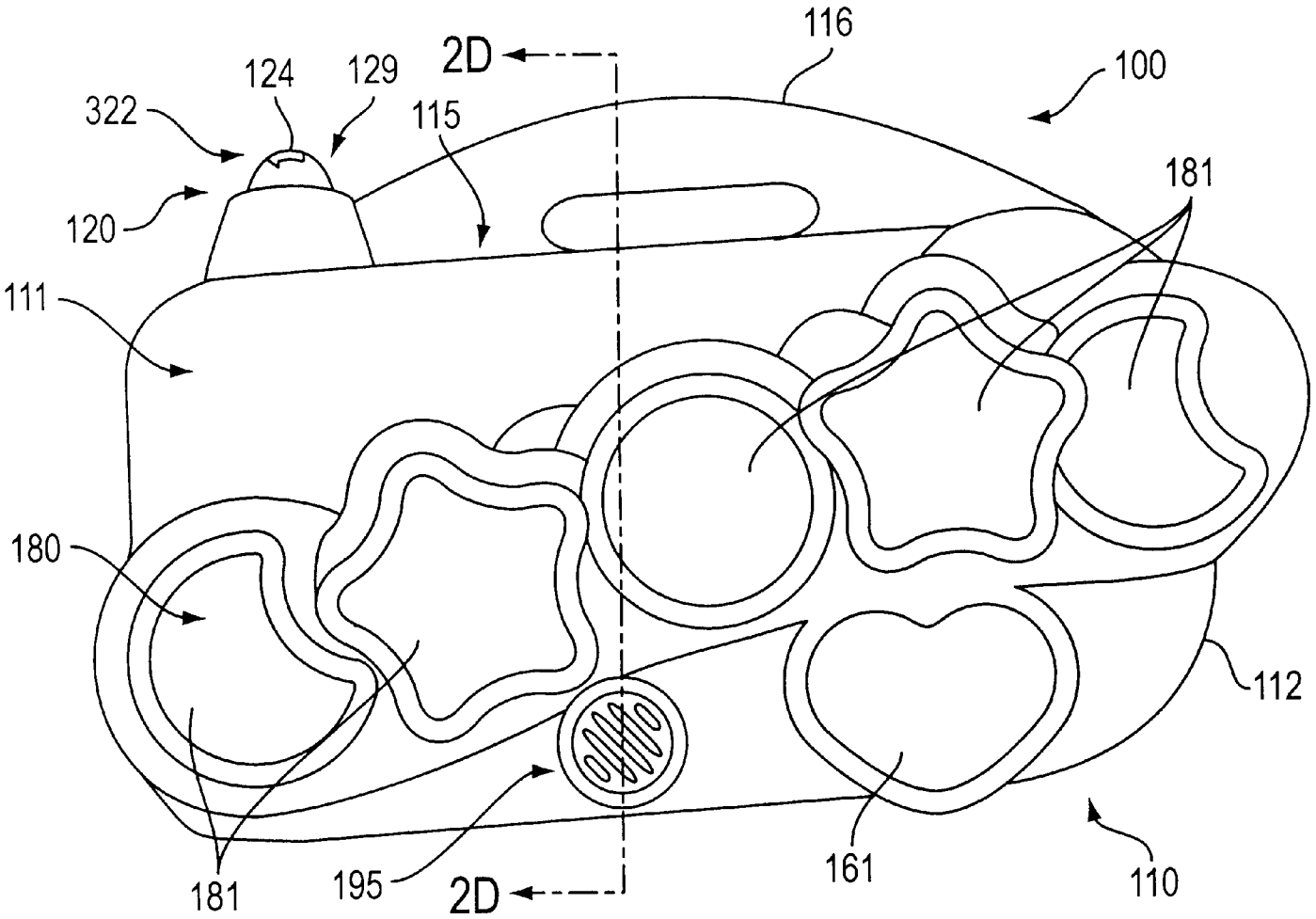
FIGS. 2A and 2B are front and rear views, respectively, of the main unit of FIG. 1B.
Figure 2B:
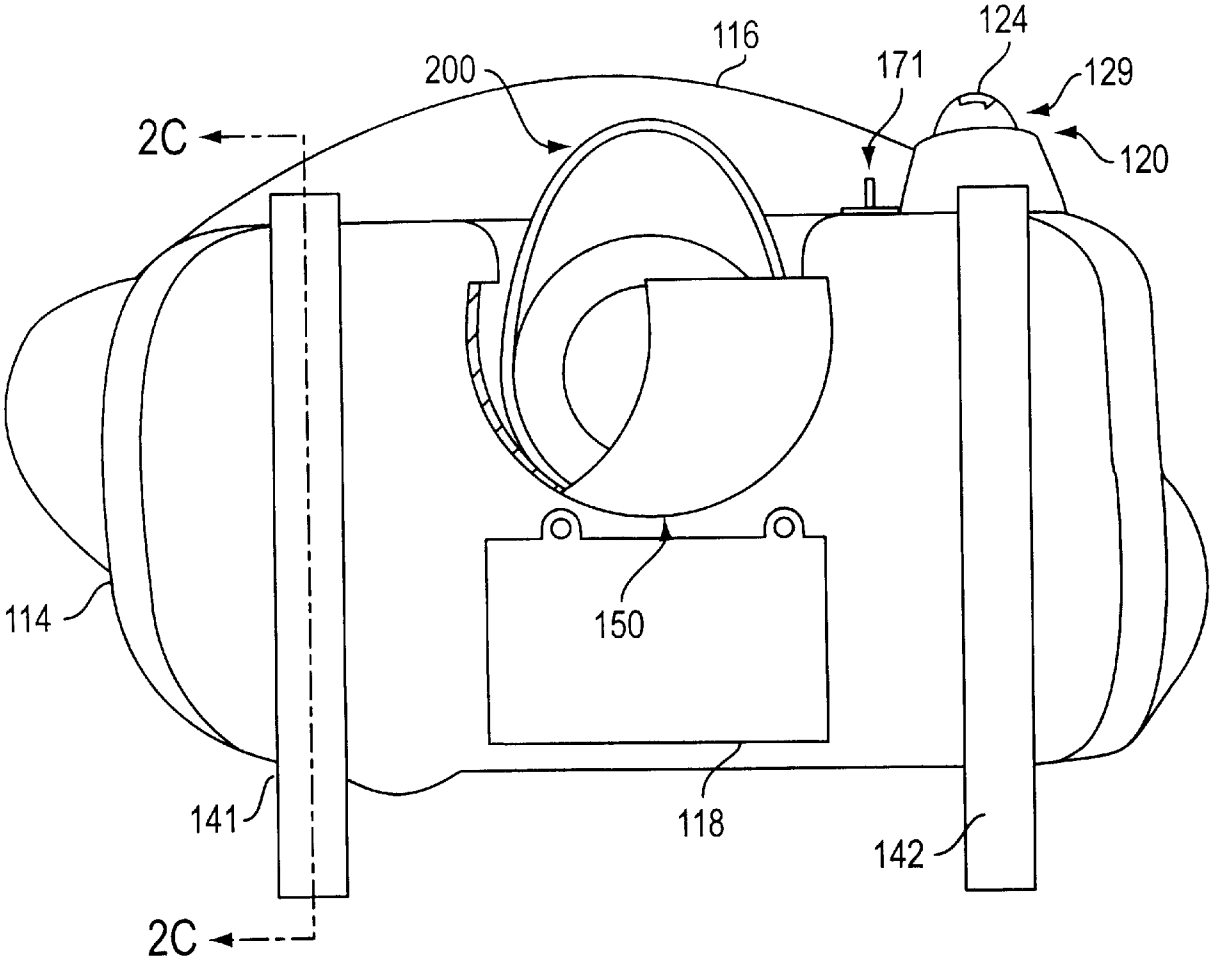
Figure 2C:
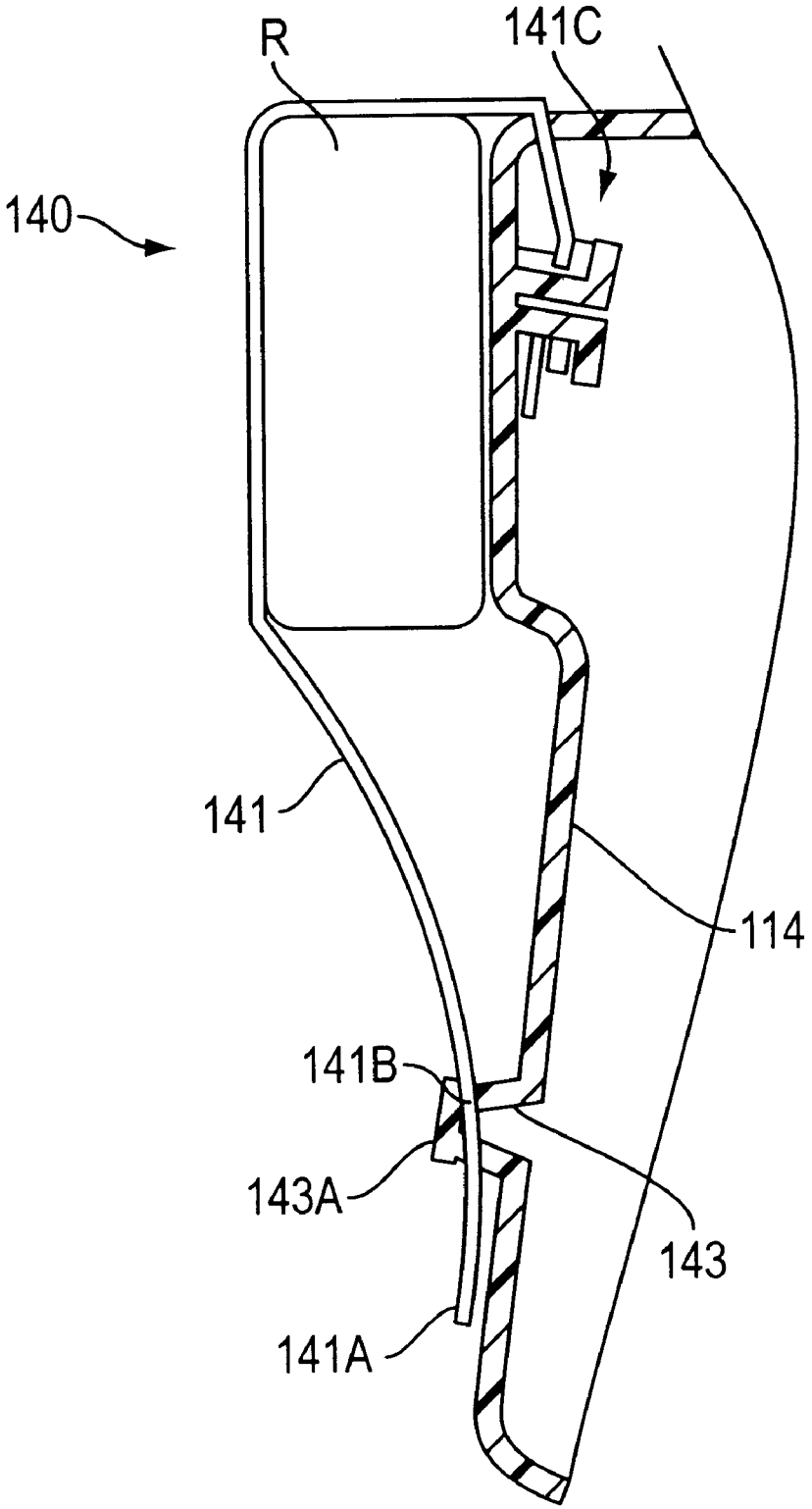
FIG. 2C is a partial cross-sectional view of the main unit of FIG. 2B taken along line 2C—2C.
Figure 2D:
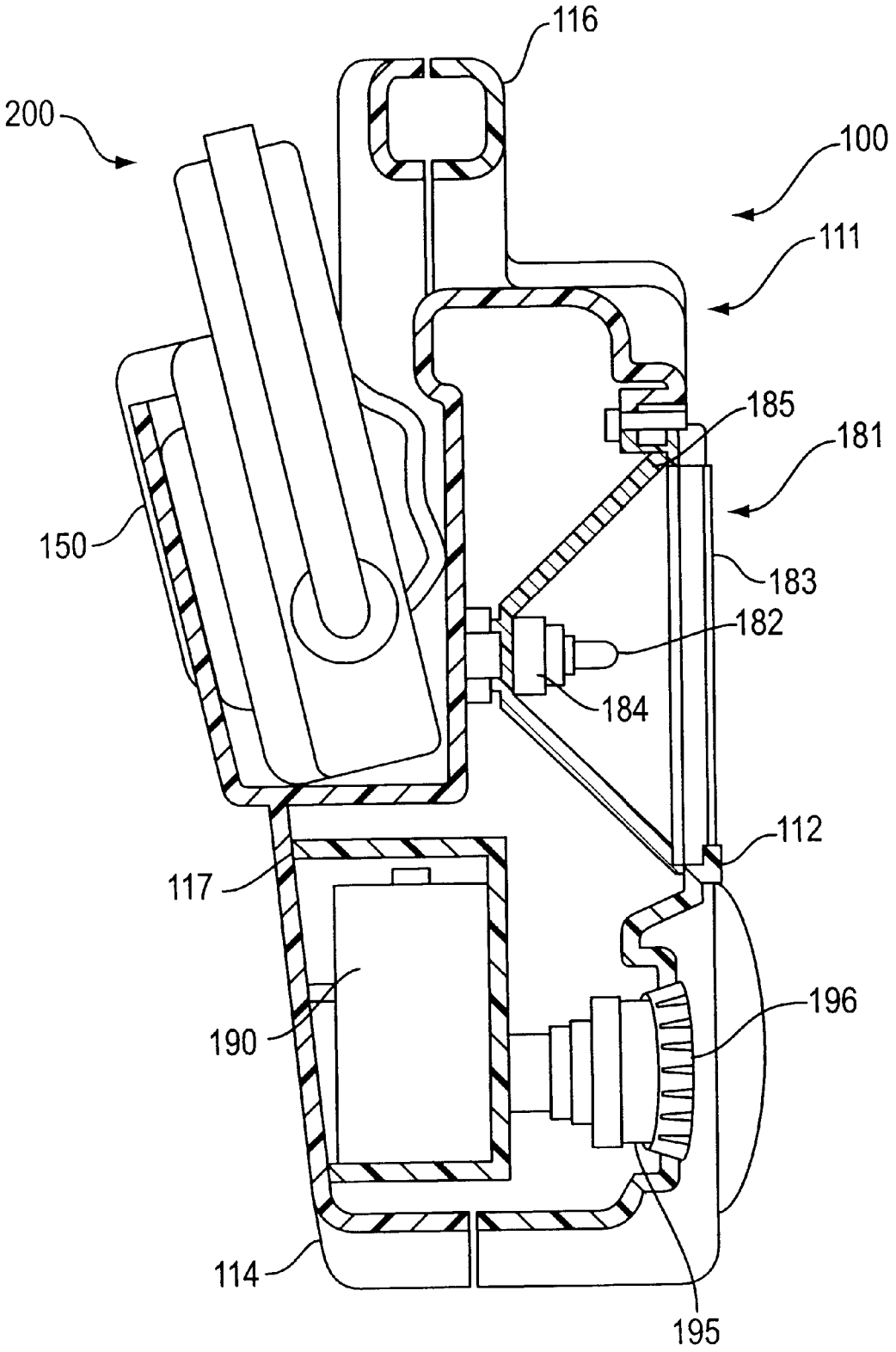
FIG. 2D is a cross-sectional view of the main unit of FIG. 1B taken along line 2D—2D of FIG. 2A, with the remote unit of FIG. 1B in its storage position in the main unit.
Figure 2F:
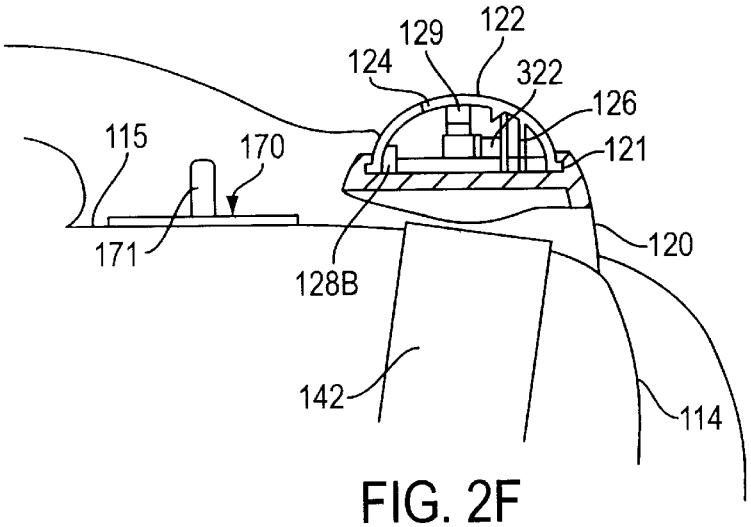
FIGS. 2E and 2F are top and rear views of the mode selector.
Figure 2E:
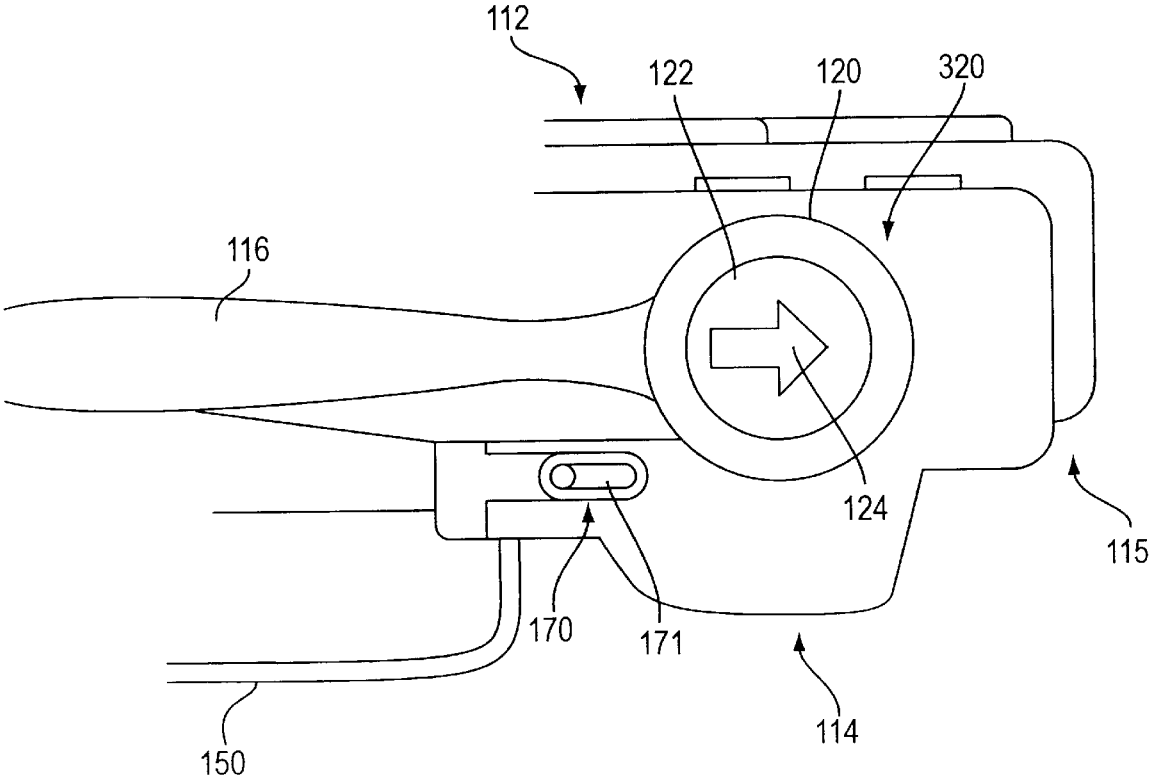
Figure 2G:
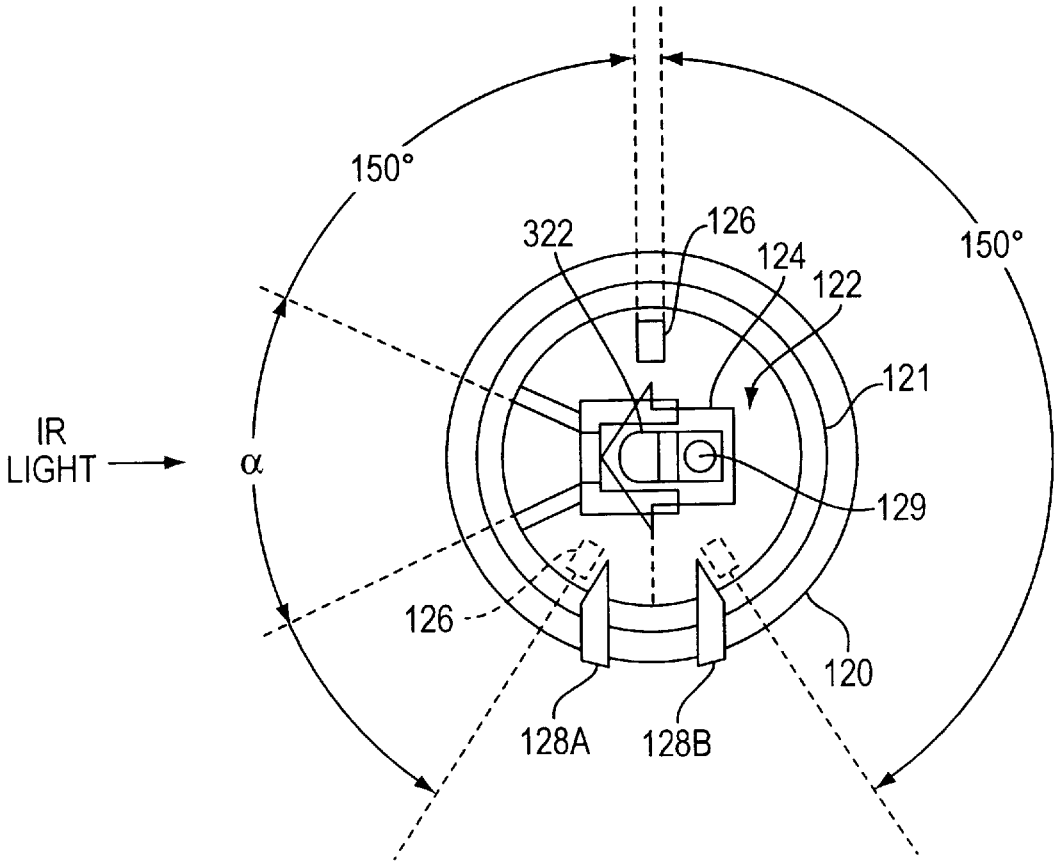
FIG. 2G is a top view of the remote receiver.
Figure 2H:
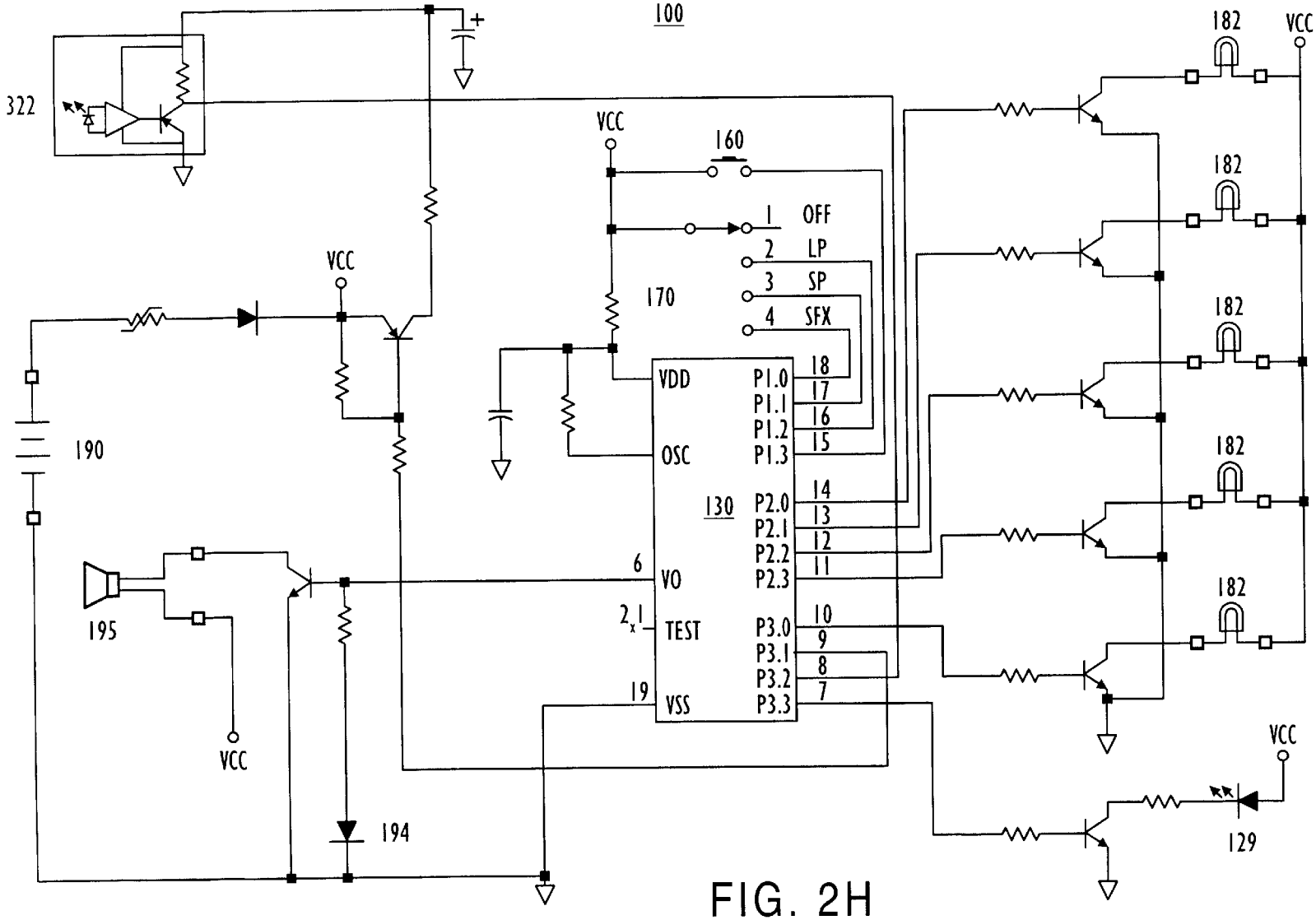
FIG. 2H is a schematic diagram of the electronic components of the main unit of FIG. 1B.

As shown in FIGS. 2A, 2E, and 2F, photosensor 322 is mounted within a photosensor mount 120 disposed on upper portion 115 of main unit housing 110. Photosensor mount 120 includes boss 121 integrally formed with housing 110 and a dome-shaped cover 122 mounted in boss 121 for rotation about a vertical axis. As shown in FIG. 2F and 2G, photosensor 322 is mounted within dome 122, which is substantially transparent to IR light. The photosensor 322 has an effective angular field of view a within which it can effectively detect incident IR signals. Field of view $\alpha$ is approximately 90°. The center of field of view a is indicated by an arrow 124 formed in the surface cover 122 to indicate to the user the approximate angular range within which the remote transmitter should be positioned to effectively communicate command signals to the receiver.

The photosensor 322 can be re-oriented to select angular positions with respect to main housing 110, to permit the user to operate the remote control from a desired position, by rotating cover 122 with respect to boss 121. The range of rotation of cover 122 is defined by the positions at which cover post 126 on cover 122 engages first and second boss posts 128A and 128B projecting from mounting boss 121, and in the illustrated embodiment is +/−150° on each side of a central position. This gives the photo sensor's fixed field of view a a variable directionality spanning approximately 360° (subject to partial obstruction by the handle 116, as is evident from FIG. 2G with FIGS. 2E and 2F). Beacon light 29A is implemented as beacon LED 129, which is mounted in the top of cover 122 adjacent photosensor 322 in a vertical orientation, and is driven by controller 130. Beacon LED 129 is illuminated in a pulsed mode when the remote receiver is active, and is illuminated continuously for a set duration (such as 1 s) when the receiver 320 has received an IR control signal from the transmitter.

Power for the electronic components of main unit 100 is supplied by main unit power supply 190, which in the illustrated embodiment consists of batteries (four C-sized cells), which are housed in battery compartment 117 and accessed via battery cover 118.

Remote transmitter 27 of remote actuator 26 is implemented as infrared transmitter 310, which is housed in remote unit 200. Infrared transmitter 310 includes a remote controller 315 (corresponding to signal generator 27B) that generates an electronic signal that is communicated to transmission LED 240 (corresponding to transmission transducer 27C), which in turn generates an IR command signal 400. In the illustrated embodiment, the remote controller 315 is a 14 stage binary counter model 74HC4060 which is a standard part commercially available from a variety of sources.

Operation of controller 315 is initiated by the user by actuating remote input switch 220 (corresponding to input 27A), which in the illustrated embodiment is a momentary contact switch with a large circular remote button 221.

Figure 5:
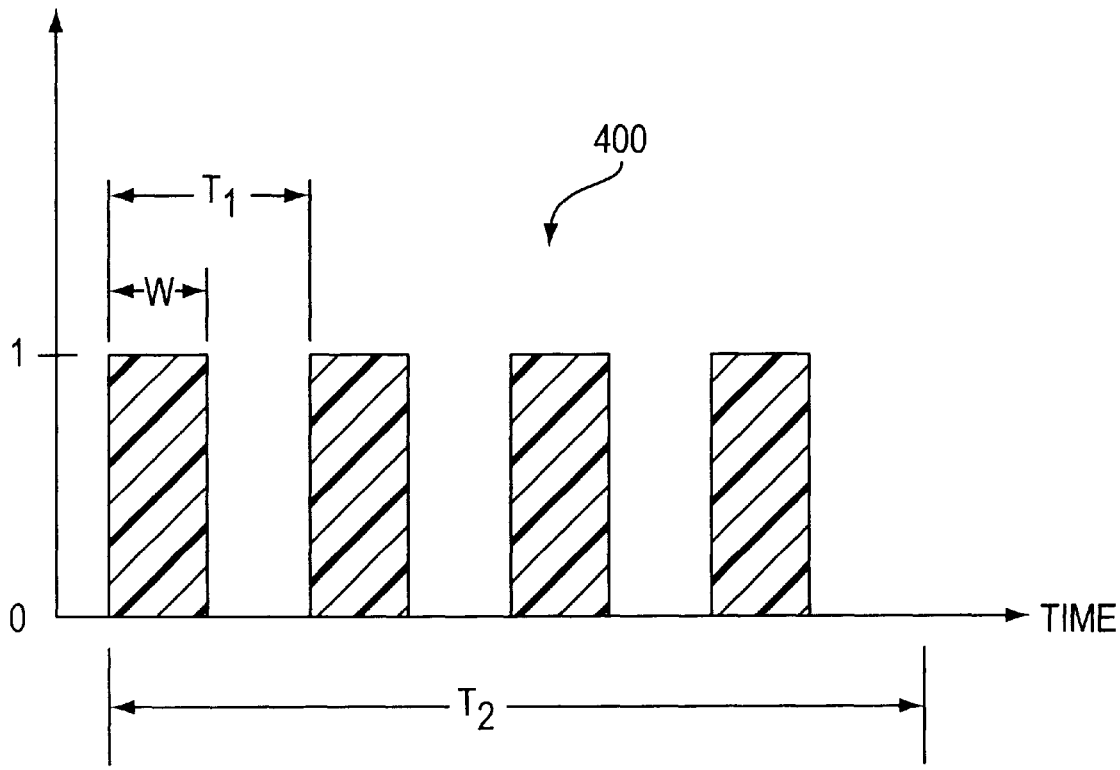
FIG. 5 shows a control signal generated by the remote unit of FIG. 1B.

Referring to FIG. 5, the IR control signal 400 generated by controller 315 and LED 240 consist of a train of square-wave pulses. Each pulse has a width w of approximately 0.85 ms, with a pulse spacing of approximately 0.85 ms, for a pulse timing $T_1$ of 1.7 ms. In response to an actuation of the remote button 221 (and thus of remote input switch 220), a four-pulse train 400 is generated and modulated on a 37.9 kHz carrier frequency (to reduce noise in the signal), with a total pulse train duration $T_2$ of 6.8 ms. As described in more detail below, command signal 400 can be interpreted as a "stop", "start" or "advance" command.

Figure 3B:
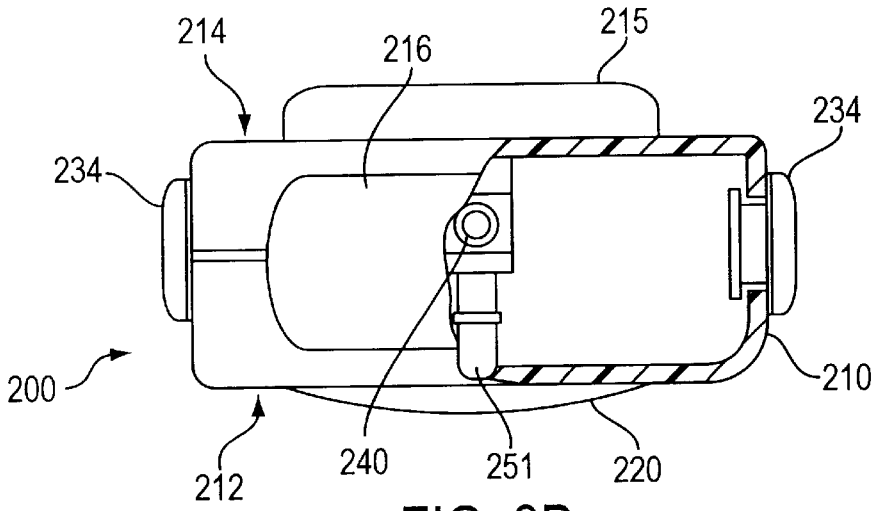
FIG. 3A, 3B and 3C are top, front and side views of the remote unit of FIG. 1B.
Figure 3A:
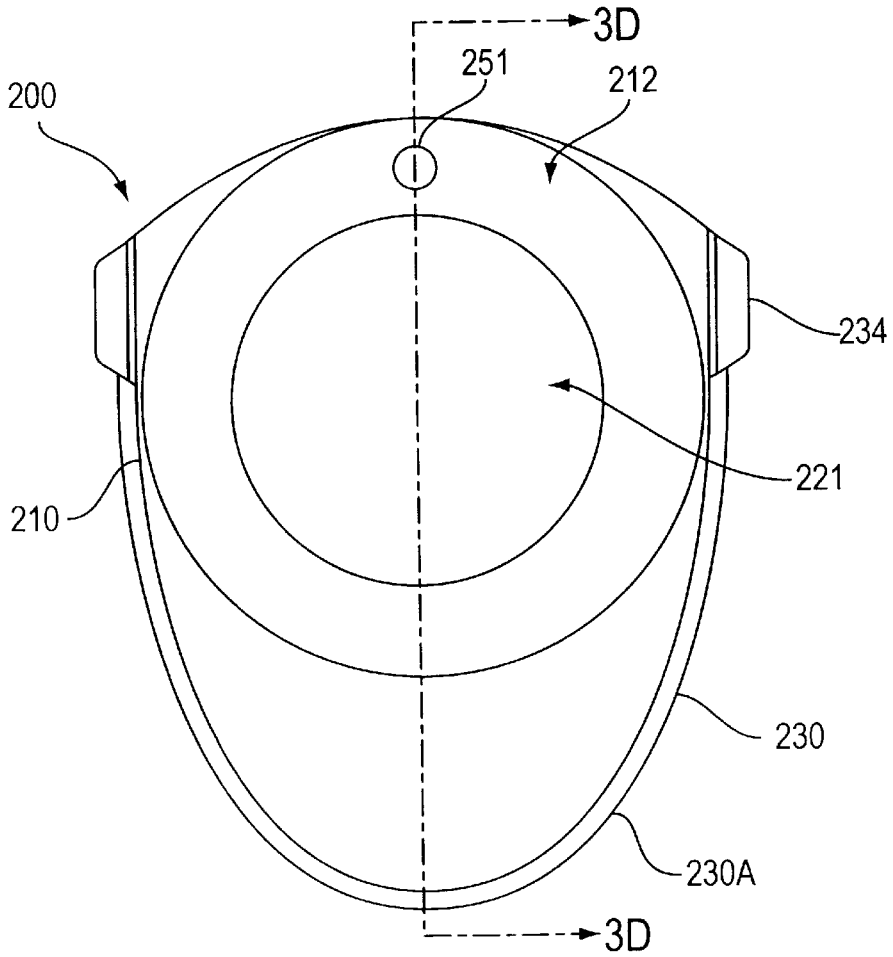
Figure 3D:
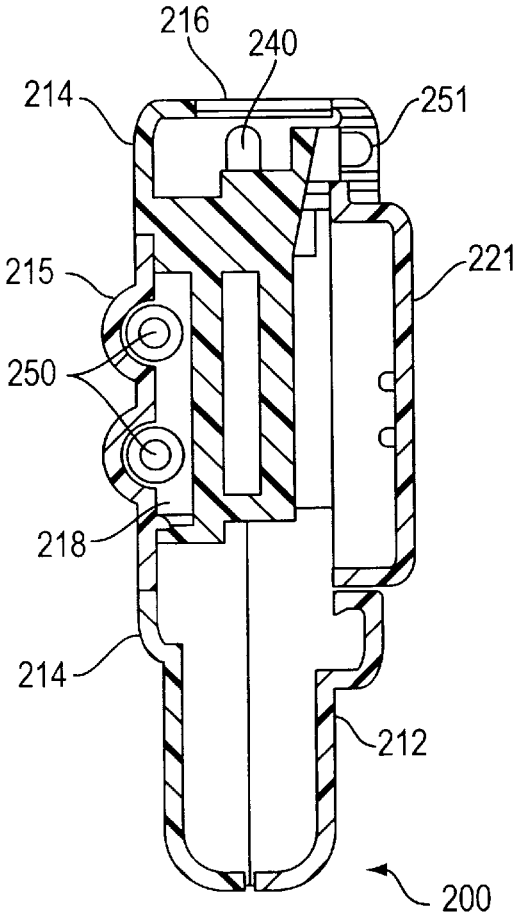
FIG. 3D is a cross-sectional view of the remote unit taken along line 3D—3D of FIG. 3A.
Figure 3C:
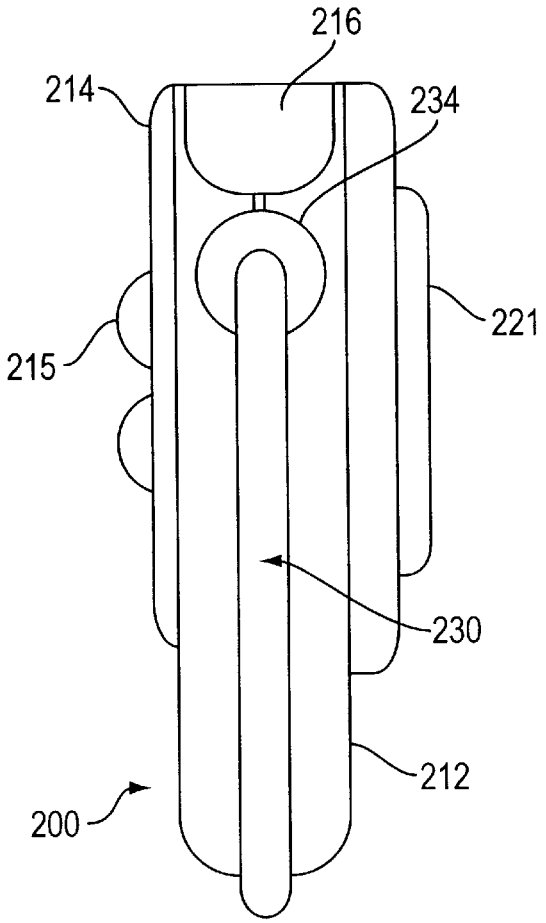
Figure 3E:
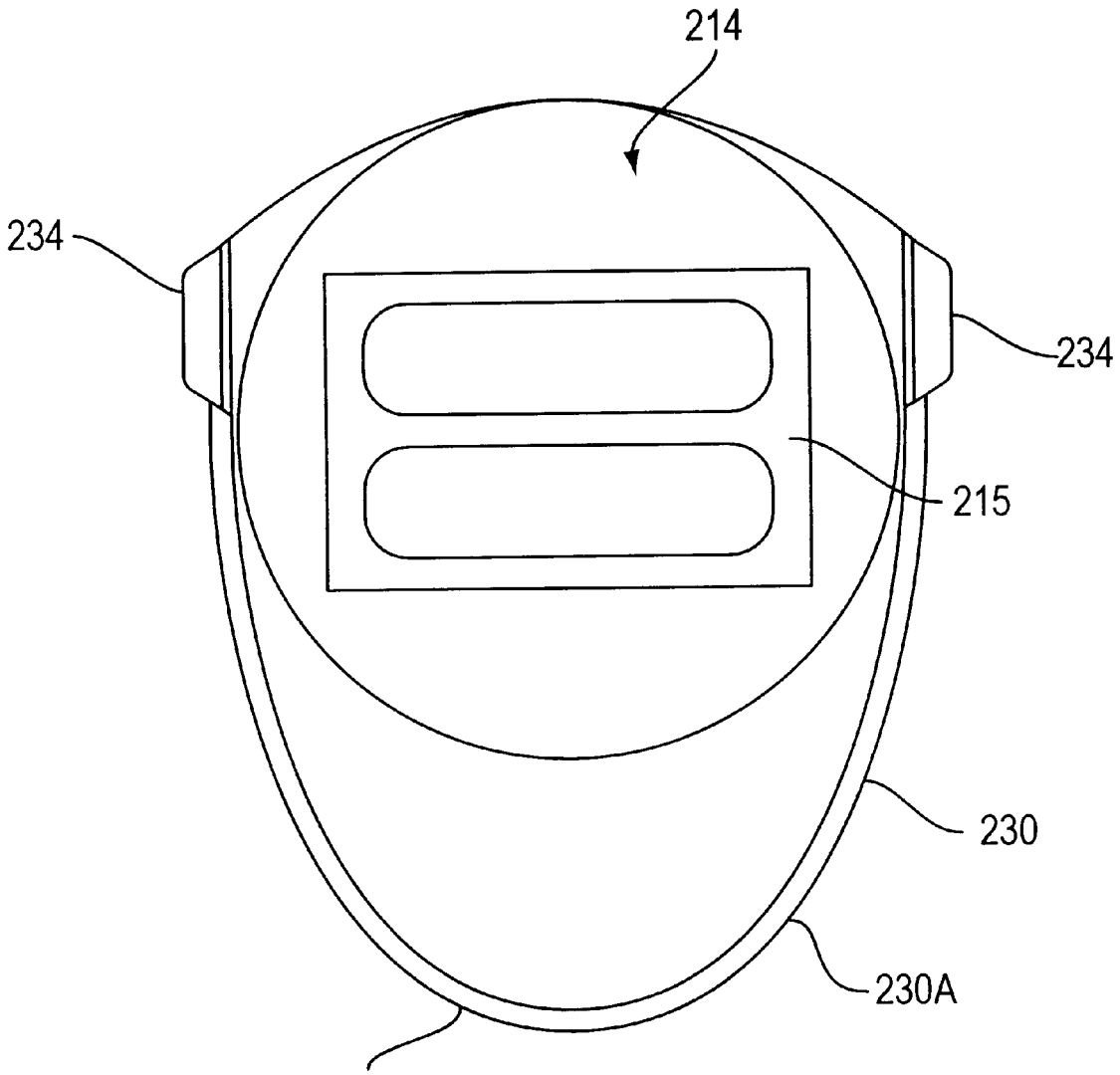
FIG. 3E is a rear view of the remote unit of FIG. 1B.
Figure 3F:
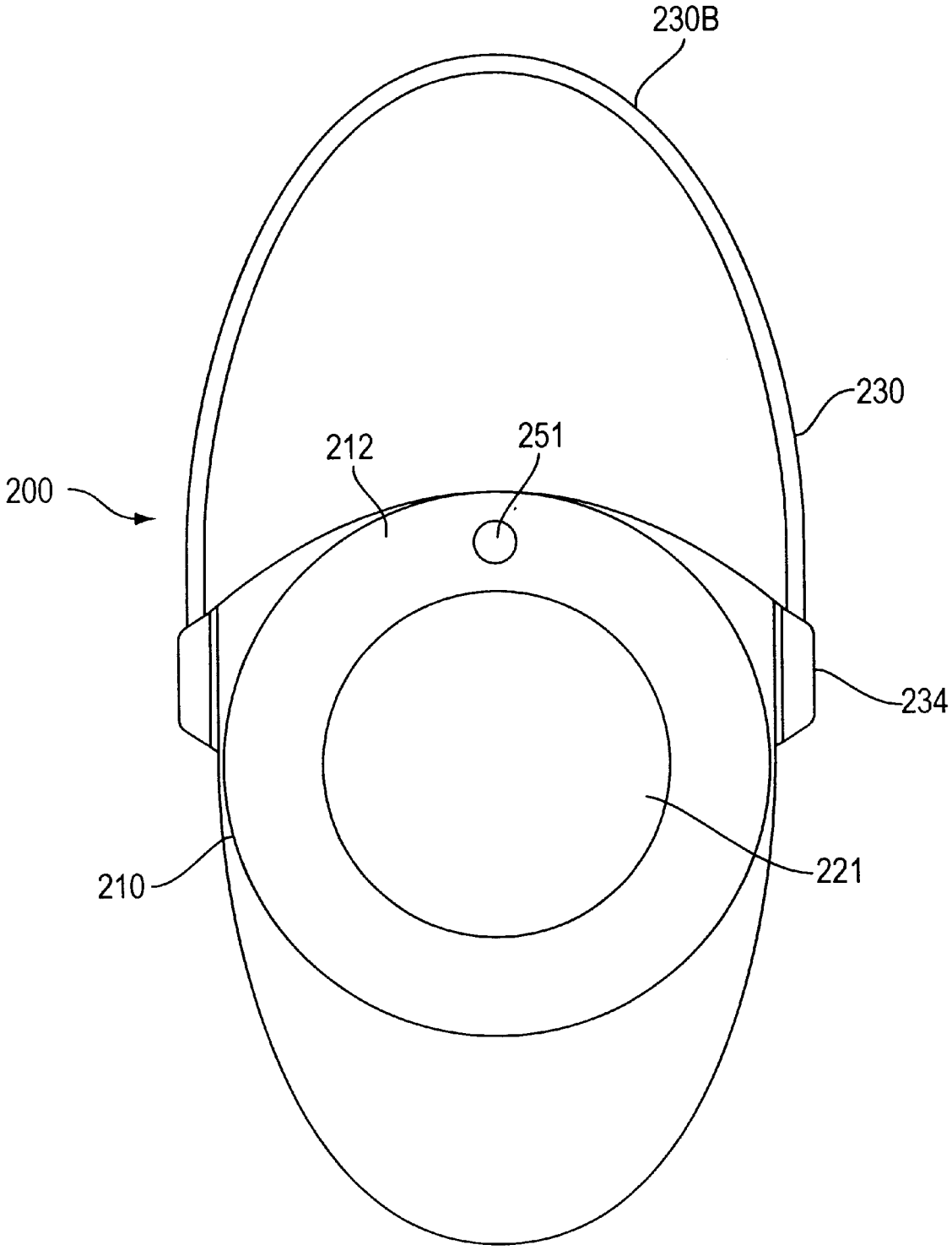
FIG. 3F is a perspective view of the remote unit of FIG. 1B.
Figure 3G:
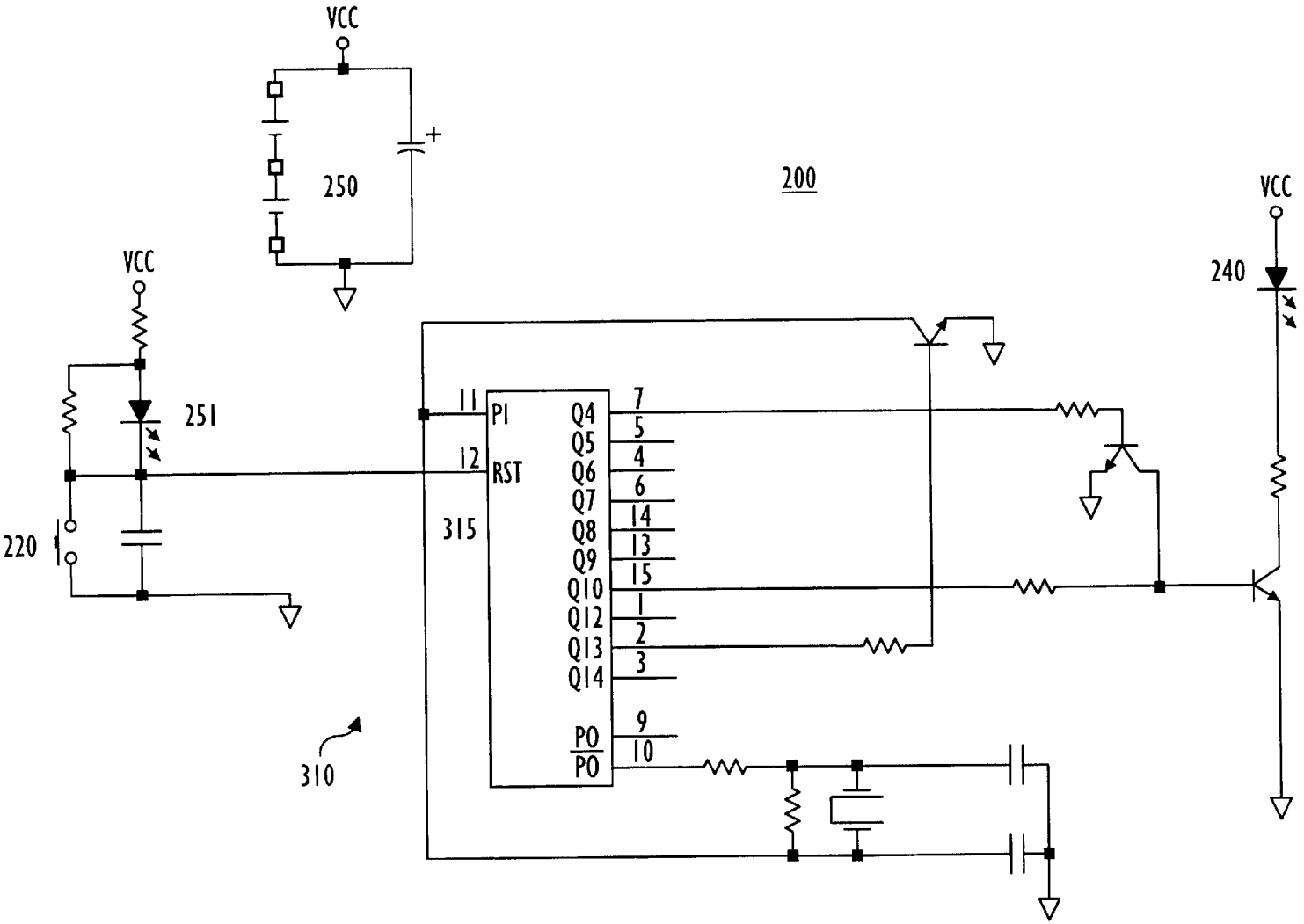
FIG. 3G is a schematic illustration of the electronic components of the remote unit of FIG. 1B.

The components of the infrared transmitter 310 are housed in remote housing 210 of remote unit 200. The remote unit 200 includes a remote unit housing 210, which is formed of a housing top 212, and a housing bottom 214. Remote unit 200 includes a U-shaped handle 230, which is pivotally mounted to housing 210 by handle pivot posts 234 that are trapped within mating semicircular cutouts in housing top and bottom 212, 214. The remote 200 can be carried or hung by the handle. FIGS. 3A, 3C and 3E shows the handle in a stowed position 230A in which it is adjacent the rear of the housing 210. FIG. 3F shows the handle in a deployed position 230B. In the deployed position, there is sufficient space between the handle and the remote housing to accommodate a standard doorknob. The handle can therefore be used to allow a parent to hang the remote unit on, for example, a doorknob at the entrance of an infant's bedroom so that the remote unit is accessible to the parent who wishes to produce sensible output for the infant without disturbing or gaining the attention of the infant by his or her presence.

An IR-transparent window 216 is also trapped between the housing top and bottom 212, 214. Transmission LED 240 is mounted in the housing behind window 216. The remote unit uses batteries 250 for a power supply. Remote button 221 is mounted in housing top 212. Indicator light 251 (corresponding to light 29B) is mounted in housing top 212 in front of button 221. A power supply 250 (two AA batteries, in the disclosed embodiment) is also contained in battery compartment 218 of housing 210, and are accessed by a removable battery cover 215.

The remote unit 200 produces IR control signals 400 for activating the main unit 100 at a remote distance, preferably at a minimum of 20' (6 m) from the remote receiver 320 in normal household lighting conditions.

As stated earlier, the crib toy is activated by receiving the IR control signal 400 from the remote unit 200 (the crib toy can also be activated by pressing the manual activation button 160). The control signal 400 transmitted from the remote unit 200 is detected by a remote receiver 320 with a photo sensor 322 for detecting short-wave IR signals modulated on a 37.9 kHz carrier frequency.

Figure 4:
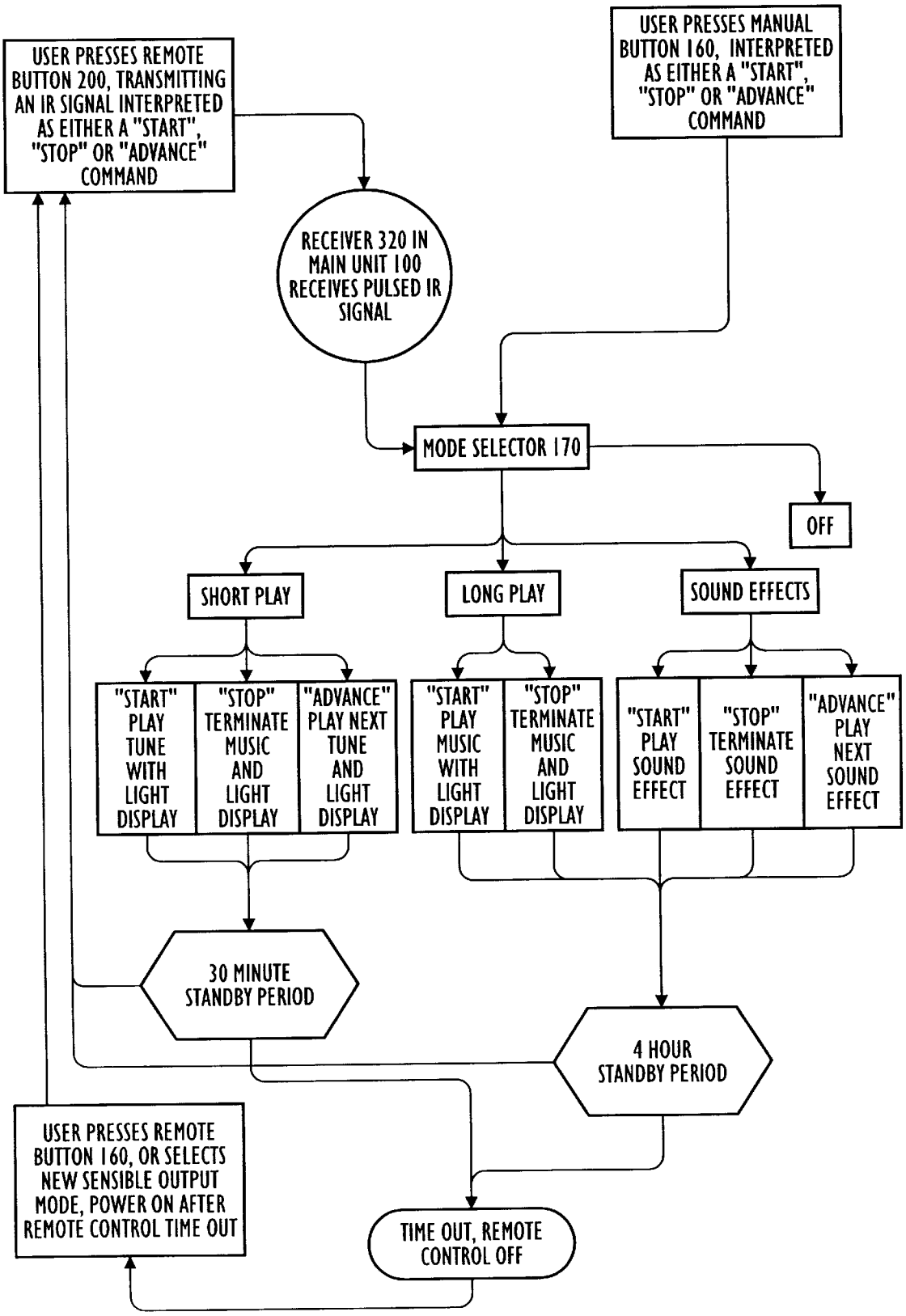
FIG. 4 is a flow chart illustrating the operation of the crib toy of FIGS. 1A and 1B.

The operation of the crib toy will now be described with reference to FIG. 4. As discussed above, the operation of the light array 181, speaker 195, beacon light 129 are controlled by controller 130. Controller 130 receives input from the remote receiver 320 or manual button 160 and responds by causing the speaker 195 and/or light array 181 to produce sensible output depending on the mode selected by the user via mode selector 170 or the nature of the IR command received. If remote receiver 320 recognizes signals from photo sensor 322 as the command signal 400, and a sensible output mode is selected, then the controller 130 will cause sensible output to be produced. If a received IR signal does not have a carrier frequency of 37.9 kHz and the signal is not the four-pulse train short-wave IR signal 400 (i.e. other remote controlled components or ambient sources such solar radiation), then the controller 130 will not produce sensible output and the beacon light 129 will not indicate that an IR signal is being received.

The short-wave IR command signals must be received while the main unit is active. Controller 130 includes an internal timer by which it can monitor the time that has elapsed since a command signal was last received. If the elapsed time exceeds an established standby period, the receiver 320 portion of the remote control will shut down to conserve power. The duration of the standby period varies according to the mode selected on the mode selector switch 170. Once powered-down, the main unit 100 will not produce sensible output in response to a second control signal but will continue to respond to a user pressing the manual button 160. Pressing the manual button 160 will also power-on the remote receiver 320, making the main unit 100 "remote ready". The main unit will also become "remote ready" if the user selects a new sensible output mode, other than "off", using the mode selector 170. Once the main unit 100 is "remote ready", the user can thereafter activate the crib toy by IR command signal 400. There is no sensible output generated when the mode selector switch 170 is set to "off".

Preferably, the three sensible output modes are a short play mode, a long play mode, and a sound effects mode. The sounds produced from each of these sensible outputs should be of a rich, soothing quality to an infant. The short play mode consists of a short musical tune (lasting approximately 1 minute) with a light pattern created by illumination of the graphic screens 183 in coordination with the music. The long play mode plays 10 minutes of musical tunes that are relaxing to a resting infant and a series of light patterns sequenced in coordination with the sounds. The sound effects mode consists of a series of relaxing sounds, such as crickets, bird sounds, or a running brook, without a light display. The standby period for the short play mode is 30 minutes. For long play and sound effects mode the standby period is four hours. Each of the three standby periods are programmed into the controller 130.

As mentioned above, the control signal 400 refers to a "start", "stop" or "advance" command. Referring to the flowchart in FIG. 4, the "stop", "start" and "advance" control signals can be sent using either the remote unit 200 or by pressing the main unit's manual button 160. To initiate a long play, short play or sound effects sensible output, the user transmits a "start" command by pressing the button 220. To end a long play, short play or sound effects sensible output before the sensible output sequence has finished, the user transmits a "stop" command by pressing the button 220 during the sensible output. If a user wishes to select another tune in the short play mode, or switch to another sound effect in the sound effects mode, then an "advance" command is required (long play mode does not recognize an "advance" command, only "stop" and "start"). To send an "advance" command, the user must first interrupt a sensible output by sending a "stop" command. After the "stop" command is received, the next control signal 400 (or a subsequent pressing of button 220) will cause the controller 130 to advance to the next sensible output sequence and begin producing this new sensible output. Thereafter, a "start" command will initiate this new sensible output until the next "stop" command is received. If a short play or sound effects sensible output mode has completed (i.e. no "stop" command is sent), then, upon sending a subsequent "start" command, the previous short play or sound effects sensible output mode sequence will be repeated. For long play mode, the sensible output is the same regardless of whether a "stop" command terminates the sensible output prematurely.

In the illustrated embodiment, the various housing components, buttons, etc. are formed of plastic materials, but any other material suitable for use can be used.

Although the disclosed audio generator has a fixed output volume, it is contemplated that a volume control could be added to permit the user to vary the output.

The power supply is disclosed as batteries, but it is contemplated that alternative sources of power could be used, include household AC power. Moreover, it is contemplated that if AC power were used, the receiver portion of the remote could always be "remote ready" since there would not be the same level of concern with conserving power.

The remotely controlled sensible output, as disclosed, uses a simply, one-function remote, however, other remotes with greater functionality are contemplated. For example, it is contemplated that remotes with buttons for remotely selecting sensible output modes or remotes which transmit Radio-Frequency (RF) verses Infra Red (IR) signals. Finally, the preferred embodiment uses audio and visual sensible output, but other forms of sensible output, such as vibratory sensible output, is contemplated.

We claim:

1. A method of producing a soothing sensible output for an infant comprising the steps of:

placing a sensible output generator comprising a housing within a sensible range of the infant;

selecting a time period from a plurality of predetermined time periods during which the output generator is active but is not producing a sensible output;

selecting a duration and type of sensible output by actuating mode selection means on said housing;

actuating an independent, hand-held remote control device to produce a control signal; and generating a sensible output in response to said control signal.

2. The method of claim 1 comprising the further step of:

varying the duration of sensible output between a short play setting and a long play setting.

3. The method of claim 1 comprising the further step of:

varying the type of sensible output between a music setting and a sound effects setting.

4. The method of claim 1 comprising the further step of:

rotating a receiver on said output generator to receive a control signal from a desired directional range.

5. The method of claim 4, wherein said receiver comprises a translucent cover through which said control signal can pass.

6. The method of claim 5, wherein said receiver further comprises a light mounted within said cover, operably coupled to said output generator, and selectively illuminable by said output generator to indicate that said receiver is active and to aid a user in determining said receiver's location.

7. The method of claim 1 comprising the further step of:

placing said remote control in a remote control receptacle mounted on said output generator.

8. A method of producing a soothing sensible output for an infant comprising the steps of:

providing a sensible output generator comprising a selector switch for varying an output mode of said sensible output generator, said output mode comprising duration and type of output;

actuating said selector switch to preselect an output mode of said sensible output generator;

setting a time period after which said output generator will not produce a sensible output in response to a control signal;

generating from a location remote from said sensible output generator a silent control signal, the output generaror receiving said silent control signal; and in response to receiving said silent control signal, activating said sensible output generator to produce a sensible output in said preselected output mode.

9. The method of claim 8 comprising the further step of:

mounting said output generator proximate to a sleeping area of an infant using mounting means.

10. The method of claim 9, wherein said mounting means comprises left and right mounting straps.

11. The method of claim 8 comprising the further step of:

varying said sensible output between an audio output and an combined audio and light output.

12. The method of claim 8 comprising the further step of:

varying the type of sensible output between a music setting and a sound effects setting.

13. The method of claim 8 comprising the further step of:

illuminating a beacon light to indicate an active mode in which said output generator will produce a sensible output in response to a control signal.

14. A method of producing a soothing sensible output for an infant comprising the steps of:

placing a sensible output generator comprising a housing within a sensible range of the infant;

setting a time period for an output generator standby mode, wherein after said time period has elapsed, said output generator will not produce a sensible output in response to said control signal;

selecting a duration and type of sensible output by actuating mode selection means on said housing;

actuating a remote control to produce a silent control signal, the output generator receiving said silent control signal; and in response to receiving said silent control signal, activating said sensible output generator to produce a sensible output of said selected duration and type.

15. The method of claim 14, wherein said sensible output comprises a light array including a plurality of lighted images.

16. The method of claim 15, wherein each lighted image comprises a light mounted behind a translucent graphic screen.

17. The method of claim 15, wherein said sensible output further comprises audio output.

18. The method of claim 14 comprising the further step of:

illuminating a beacon light to indicate an output generator active mode.

19. The method of claim 18 comprising the further step of:

extinguishing the illumination of said beacon light to indicate said output generator standby mode.

20. The method of claim 14 comprising the further step of:

illuminating a beacon light to indicate the receipt of a silent control signal from said remote control.

* * * * *

UNITED STATES PATENT AND TRADEMARK OFFICE

CERTIFICATE OF CORRECTION

PATENT NO. : 6,116,983
DATED : September 12, 2000
INVENTOR(S) : Jennifer LONG *et al.*

It is certified that error appears in the above-identified patent and that said Letters Patent is hereby corrected as shown below:

In column 2, line 56, change "an" to --can--

In column 3, line 47, insert -- -- between "or" and ""repeat""

In column 4, line 57, change "141 C" to --141C--

In column 4, line 58, change "141 C" to --141C--

In column 4, line 59, change "141 A" to --141A--

In column 5, line 63, change "12043SM" to --12043 SM--

In column 6, line 12, change "a" to --α--

In column 6, line 14, change "a" to --α--

In column 10, line 3, change "generaror" to --generator--

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*